United States Patent [19]

Tucker

[11] 4,044,413

[45] Aug. 30, 1977

[54] CLAMP ASSEMBLY WITH GUIDE MEANS FOR REMOVING SELECTED ARC LENGTH OF CLAMPED RING FOR SIZE REDUCTION

[76] Inventor: Dalton R. Tucker, 1803 Rockefeller Lane, Redondo Beach, Calif. 90277

[21] Appl. No.: 727,697

[22] Filed: Sept. 28, 1976

[51] Int. Cl.[2] ..... B25B 7/22

[52] U.S. Cl. ..... 7/3 R; 7/1 M; 81/420; 81/425 A

[58] Field of Search ..... 81/418, 420, 425 R, 81/425 A; 7/1 M, 3 R

[56] References Cited

U.S. PATENT DOCUMENTS

| | | | |
|---|---|---|---|
| 3,153,957 | 10/1964 | Madeira | 81/425 R |
| 3,383,963 | 5/1968 | Vondrachek | 81/425 R |
| 3,842,696 | 10/1974 | Wayne | 81/425 R |
| 3,908,490 | 9/1975 | Durham | 81/420 |

*Primary Examiner*—James L. Jones, Jr.
*Attorney, Agent, or Firm*—Howard L. Johnson

[57] ABSTRACT

A handable clamp such as a vice grip, carrying a pair of interlocking arcuate-faced extension jaws, one of which is laterally projecting on both sides of clamp jaws and formed with parallel-sided tongues and guide slots spaced apart by aliquot distances, whereby selection of a pair of such walls as guides for saw blade will enable severance of chosen arc-length of clamped ring. The thus-matching butt-ends of the ring can then be secured together to form a ring of smaller size. The projecting jaw tongue and slot pattern is reproduced with indicia on associated reference surface, such as a decal, to indicate position of particular pairs of cuts corresponding to chosen arc length.

5 Claims, 5 Drawing Figures

CLAMP ASSEMBLY WITH GUIDE MEANS FOR REMOVING SELECTED ARC LENGTH OF CLAMPED RING FOR SIZE REDUCTION

BACKGROUND OF THE INVENTION

It is frequently desired to reduce the circumference or size of a finger ring so as to make it fit the finger of a new owner or wearer. A short span is cut out of the hoop and the butt ends are then brought together and secured as by metal-to-metal sealing. However, when sawing through the band, the path of the saw blade may deviate from a true radial cut so that the severed end may slant in either direction and thus produce a non-conforming butt end, as well as a somewhat greater or lesser open-span than initially calculated or desired. In addition, sometimes with softer metals or alloys an inadequately supported length may bend or crumble in the course of severance; one result is that an entire band must be reconstituted. Beyond this, is the recurrent problem of trying to visually transfer a desired severance length to the workpiece, or alternately maintaining a mensuration guide along the clamped ring.

STATEMENT OF THE INVENTION

The invention provides a pair of arcuate-faced interlocking extension jaws which may be added to or formed integral with (narrow-width) jaws of an ordinary clamp assembly, particularly a handable vice clamp, such as may be used to clamp a finger ring in order to convert it to a smaller size by first removing a segment of selected length and then sealing together the cut ends. One of the extension jaws projects laterally from each side of the basic clamp jaws and is formed with longitudinal tongues defining open-ended parallel-sided slots therebetween. Each such parallel wall including those of the outer side-edges of the tongue-plate are usuable as guide walls in making cuts on a clamped ring segment (as with a jeweler's scroll saw), the tongues being of unequal width and all the parallel guide walls being laterally spaced apart by aliquot distances related to ring size. Hence the artisan uses the combination of a selected pair of guide walls which span the desired arc length to be removed. A mensuration plot superposed on the tongue and slot pattern is associated with the assembly as a reference chart, which may be attached or separate.

DETAILED DESCRIPTION OF PREFERRED EMBODIMENT

Figure 1:
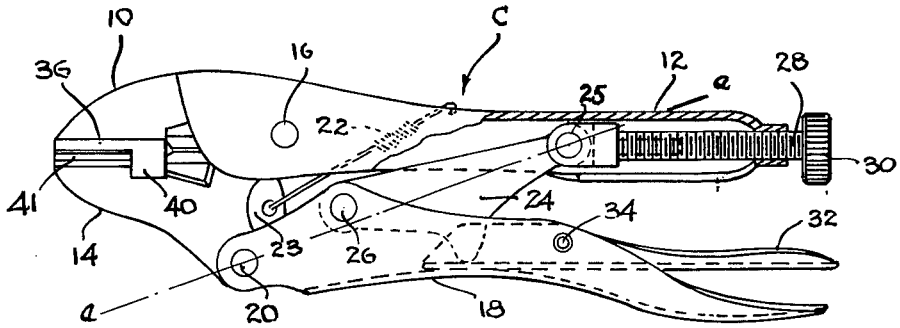
FIG. 1 is a side elevational view, with portions in section or phantom, of a vice clamp modified by addition of a pair of extension jaws in accordance with the present invention.
Figure 2:
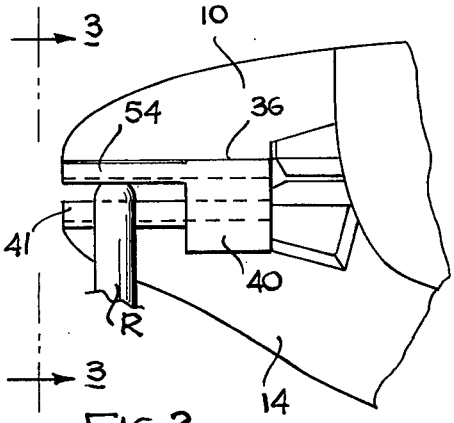
FIG. 2 is an enlarged side elevation of the jaw-end of the clamp, shown holding a ring segment.
Figure 3:
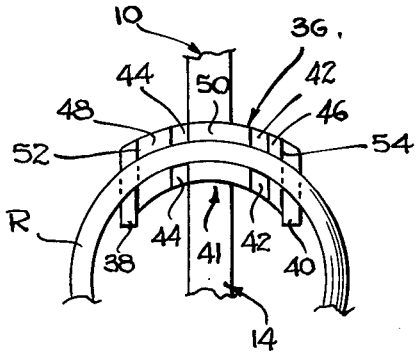
FIG. 3 is an end view of the clamped ring and jaws, taken along line 3—3 of FIG. 2.
Figure 4:
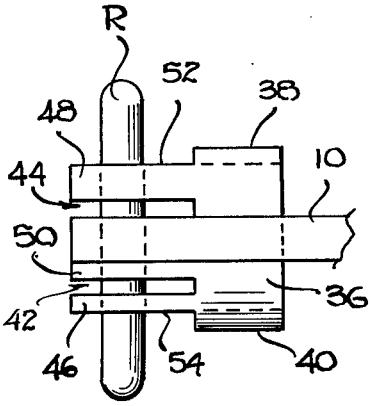
FIG. 4 is a top plan view of the jaw-end of FIG. 2.

As seen in FIG. 1, the basic structure of a vice clamp C is provided by an upper or fixed jaw 10 which may be integral with a fixed clamp handle 12 of U-shaped channel configuration, and a movable jaw 14 pivoted to the fixed handle at 16 and pivoted to a leverage handle 18 at 20. A tension spring 22 connects a lug 23 of the lower jaw to the fixed handle, thus biasing the jaw to open position. One end of a linkage or toggle arm 24 is pivoted at 26 to the movable handle, with its other end received in the U-channel of the fixed handle and adjustably pivoted at 25 in end-abutment with an adjusting screw 28 which is threadedly carried by a closed segment of the channel, being manipulable by a projecting head 30. A release lever 32 is carried on a cross pin 34 with its inner end disposable (when the handle is closed) for engagement with a projection of the toggle arm 24, so as thus to unlock the jaws from clamped position. The adjusting screw 28 sets the span of the jaws when open; when the pivot point 26 crosses the line a-a which joins 20 and 25, the jaws lock on the clamped workpiece (and the worker no longer needs to hold them shut). Such a vice-clamp is shown in U.S. Pat. No. 2,514,130.

An extension jaw 36 is secured overlying the clamp face of the fixed jaw, the extension jaw being essentially an arcuate-faced plate, with its proximate edge coextensive with that of the jaw nose and laterally extending from both sides of the fixed jaw 10, with a distal length formed with turned-down wings 38, 40 along respective sides so as to form edge-engagement means relative to a lower, corresponding arcuate, extension plate or jaw 41 which is carried by the lower or movable clamp jaw 14.

The proximate or forward portion of the upper extension jaw 36 is formed with a pair of open-ended, parallel-sided slots 42, 44, which delineate a pair of forward-projecting tongues 46, 48 thus spaced laterally from the central tongue or nose section 50. The outer side walls or edges 52, 54 are also parallel to the walls of the slots 42, 44 so that all of these form guide walls, any pair of which can be selected in order to cut out a segment of different arcuate length from a clamped ring or workpiece R.

Figure 5:
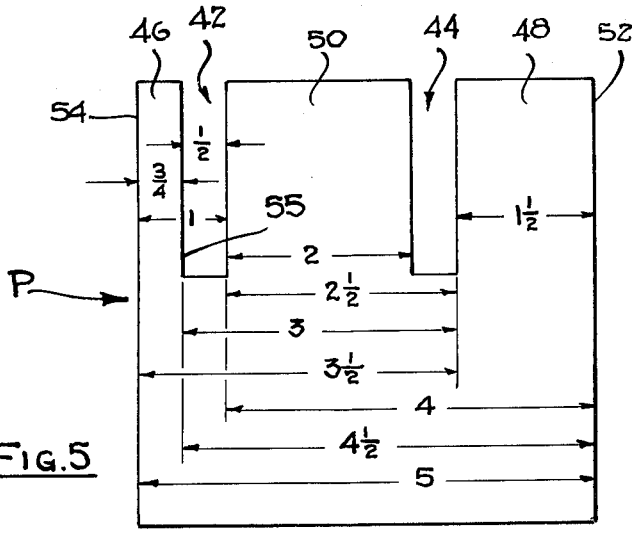
FIG. 5 is a face view of a measurement chart or spacing pattern of the slot and tongue elements of the upper extension jaw showing the different segment lengths which may be cut out from a clamped ring by severance along a selected pair of guide walls.

The mensuration pattern is shown on the surface member or plate P (FIG. 5) which plate may be attached to the clamp assembly (for example, as a decal) or may be provided as a separate reference display panel on a container-carton, or be given a stiff backing for attaching to a wall or work bench. The numbers shown in FIG. 5 correspond to ring sizes. The width of each slot 42, 44 is one half size, as is also the width of the tongue 46. Thus, by moving a saw blade along successive (inner) side walls of either slot, the length of the severed arc segment of the clamped workpiece R corresponds to one-half a ring size. However, if instead, the blade is moved along the outer walls 54, 55 of the tongue (of the same half-size width), the longer arc thus severed will approximate $\frac{3}{4}$ size; the greater width is due to making "outside" cuts rather than "inside" ones. Overall, it will be seen that the width of each successive tongue and slot is an aliquot fraction of the total span, that is, 5 units, which would be severed by cuts made along terminal guide walls 52 and 54. By selecting a pair of guide walls of lesser span, progressively smaller size cuts are obtained, thus $4\frac{1}{2}$, 4, $3\frac{1}{2}$, 3, $2\frac{1}{2}$, 2, $1\frac{1}{2}$, 1. ($\frac{1}{2}$ size = 0.05 inch)

I claim:

1. A composite clamp assembly comprising a clamp having a pair of adjustable clamp jaws and means for functionally opening and closing same, each clamp jaw carrying an extension jaw having clamp faces of corresponding transverse arcuate curvature and disposed in position to clamp an arcuate segment of a workpiece such as a ring therebetween, one extension jaw consisting of an arcuate surfaced plate laterally projecting beyond one of said clamp jaws, such projecting portion being characterized by at least one longitudinal tongue forming an open-ended guide slot having mutually parallel side walls extending adjacent a side of the clamp jaw, each side of said slot and of said tongue thus forming guide walls jointly defining different arc lengths of a clamped workpiece, the width of said slot and of said tongue corresponding to aliquot parts of an arcuate unit distance, whereby a desired arc length of a clamped workpiece may be severed by making cuts along a selected pair of said guide walls as by moving a juxtaposed sawblade therealong, said clamp assembly including interlocking means for preventing lateral displacement of one extension jaw relative to the other when in functional engagement.

2. The clamp assembly of claim 1 wherein said one extension jaw laterally projects beyond each side of its clamp jaw, each projecting portion being formed with at least one of said tongue and guide slots, the width of each tongue and guide slot forming an aliquot of the total extension jaw span across both laterally projecting portions, the outer edge of each projecting portion also serving as a guide wall.

3. The clamp assembly of claim 2 wherein said interlocking means comprise longitudinal edge abutment means disposed adjacent opposite sides of one of said extension jaws in position to progressively engage corresponding side edges of the opposing extension jaw.

4. The clamp assembly of claim 3 wherein said clamp jaws form part of a handable vice clamp having leverage-operated closing means and including selective means for locking together the leverage clamped jaws when functionally engaging a workpiece.

5. The clamp assembly of claim 1 in combination with an indexed surface member bearing the tongue and slot pattern of said one extension jaw, plus indicia relating the length of different arcs measurable in relation to selected pairs of guide walls of said extension jaw.

* * * * *